US006314881B1

(12) United States Patent
Götting

(10) Patent No.: US 6,314,881 B1
(45) Date of Patent: Nov. 13, 2001

(54) PRINTING GROUP FOR A PRINTING PRESS

(75) Inventor: Georg Götting, Lörrach (DE)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/268,689

(22) Filed: Mar. 16, 1999

(30) Foreign Application Priority Data

Mar. 16, 1998 (EP) ..... 98810217

(51) Int. Cl.[7] ..... B41F 5/00
(52) U.S. Cl. ..... 101/216; 101/247
(58) Field of Search ..... 101/216, 217, 101/218, 247

(56) References Cited

U.S. PATENT DOCUMENTS 2,503,858 * 4/1950 Waterworth ..... 270/68
3,732,813 5/1973 Singh et al. ..... 101/216
4,926,666 * 5/1990 Gotting et al. ..... 72/247
5,901,648 * 5/1999 Roland et al. ..... 101/218

FOREIGN PATENT DOCUMENTS 195 01 243 A1 1/1995 (DE) ..... 13/21
0 771 648 A1 9/1996 (EP) ..... 13/12
0 295 449 A2 5/1988 (EP) ..... 13/20
0 531 880 A1 9/1992 (EP) ..... 13/28

* cited by examiner

*Primary Examiner*—Ren Yan
(74) *Attorney, Agent, or Firm*—Venable; Robert Kinberg

(57) ABSTRACT

A printing group for a printing press includes a plate cylinder, a blanket cylinder operatively coupled to the plate cylinder, and a further cylinder operatively coupled to the blanket cylinder. The blanket cylinder includes two end faces, each of which has a conical bearer ring. The further cylinder also includes two end faces, each of which has a conical bearer ring. The conical bearer rings of the blanket cylinder roll onto the conical bearer rings of the further cylinder under pressure.

9 Claims, 3 Drawing Sheets

PRINTING GROUP FOR A PRINTING PRESS

CROSS-REFERENCE TO RELATED APPLICATIONS

Priority is claimed with respect to European Application No. 98810217.4-2304, filed in the European Patent Office on Mar. 16, 1998, the disclosure of which is incorporated herein by reference.

BACKGROUND OF THE INVENTION

The invention relates to a printing group for a printing press, particularly a rotary offset press, having at least one plate cylinder, one blanket cylinder and one counter pressure cylinder, or a further blanket cylinder and a further plate cylinder.

A printing group of this type is known from European Patent document EP-A-0 531 880. In such printing groups, the elements involved in the printing process, such as gears, bearings and cylinders, must be produced and assembled with very high precision, because otherwise printing defects occur in the form of streaks, blotting or double printing. One such printing defect, known as channel streaking, appears more frequently as the print speed increases.

To avoid these defects, it is further known to mount so-called bearer rings on the two end faces of the plate and blanket cylinders. These rings are hardened, cylindrically ground steel rings that run onto one another under pressure. They reinforce the printing group by extensively eliminating the play and elasticity of the cylinder seatings, because the cylinders roll onto the bearer rings under a pre-stress. The bearer rings prevent the cylinders from decreasing their spacing in the cylinder channels, where the compressive stress temporarily breaks down, and then moving slightly further apart again with the next introduction of pressure.

The use of the aforementioned bearer rings, however, has the disadvantage that the spacing between the cooperating cylinders cannot be adjusted. During printing, the compressive stress, that is, the spacing between the blanket and counter pressure cylinders, should be adjustable to permit an adaptation to different paper thicknesses or paper surfaces. With cylindrical bearer rings, the thickness of the blanket cylinder cover would have to be changed for this type of spacing adaptation, which would in turn change the compressive stress between the blanket and plate cylinders. However, the compressive stress here should be constant. Thus, the cover thickness of the plate would also have to be changed. This in turn changes the printing length, which is not permissible in most cases.

Because of these problems, only bearer rings are used between plate and blanket cylinders in the aforementioned printing groups. The bearer rings extensively eliminate the channel impact between these two cylinders, but not the channel impact between the blanket and counter pressure cylinders or the first and a second blanket cylinders.

In European Patent document EP-A-0 531 880, the channel impact between the blanket and counter pressure cylinders or the first and second blanket cylinders is treated with special stops and cylinder arrangements.

It is also known to use rubber blankets in sleeve form to avoid the channel impact. Changing these blankets is an involved process, however, because, for example, the side wall and/or the respective cylinder seating on one side must be removed for changing the sleeves.

SUMMARY OF THE INVENTION

It is an object of the invention to provide a printing group of the aforementioned type, which permits infinitely adjustable axial spacing (i.e. spacing between the axes) for blanket and counter pressure cylinders, or for blanket-blanket cylinders in blanket-blanket printing groups, without sacrificing the advantages of bearer rings.

The above and other objects are accomplished in the context a printing group for a printing press including a plate cylinder, a blanket cylinder operatively coupled to the plate cylinder, and a further cylinder operatively coupled to the blanket cylinder, wherein according to the invention the blanket cylinder includes two end faces each of which has a conical bearer ring, the further cylinder includes two end faces each of which has a conical bearer ring, and there is additionally provided means for applying pressure to the blanket cylinder so that the conical bearer rings of the blanket cylinder roll onto the conical bearer rings of the further cylinder under pressure. In one embodiment of the invention, the further cylinder comprises a counter pressure cylinder and in another embodiment the further cylinder comprises a further blanket cylinder and in this latter embodiment there is additionally provided another plate cylinder operatively coupled to the further blanket cylinder.

In the printing group of the invention, the axial spacing between the blanket and counter pressure cylinders, or between the two blanket cylinders, can be infinitely adjusted, for example, by displacement of the counter pressure cylinder (or of the further blanket cylinder) in its axial direction by means of a spindle. The axial spacing between the plate and blanket cylinders is not changed by this adjustment.

Play between teeth in drive gears can easily be rendered substantially ineffective according to a further feature of the invention, whereby the rolling contact diameter of the bearer rings on the driving cylinder is made smaller than the rolling-contact diameter of the bearer rings on the driven cylinder, while the gears maintain same number of teeth. This arrangement effects a frictional force between the bearer rings that renders play between teeth ineffective. This type of play occurs when the axial spacing between the two cylinders is increased.

Further, advantageous features ensue from the following description of two embodiments of the invention when considered in conjunction with the accompanying drawings.

DETAILED DESCRIPTION OF THE INVENTION

Figure 1:
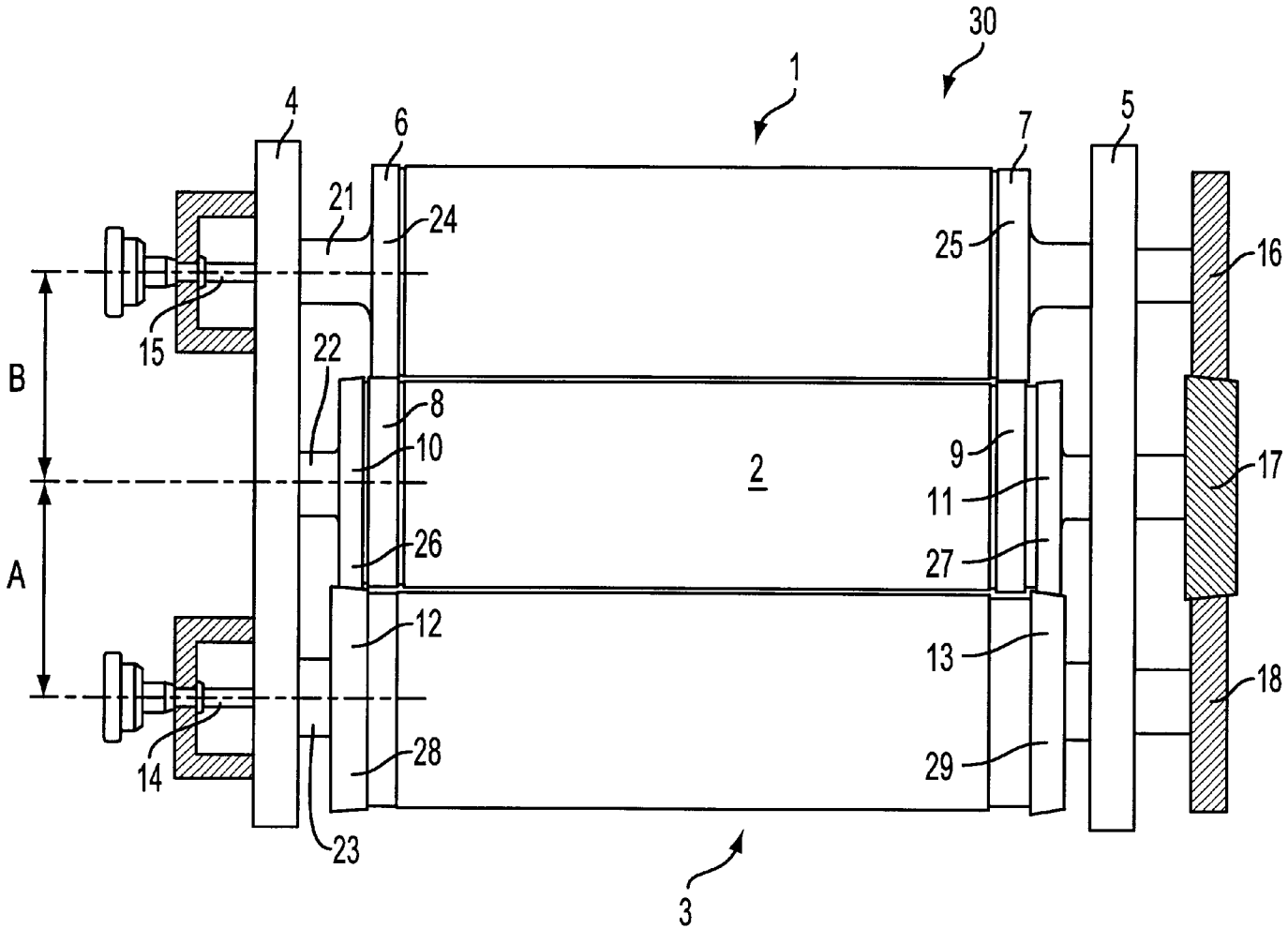
FIG. 1 is a schematic lateral elevation, in partial section, of a printing group according to one embodiment of the invention.

FIG. 1 shows a printing group 30 which includes a conventional plate cylinder 1 seated in lateral shields 4 and 5. The seating, not shown in detail here, has a conventional design. Plate cylinder 1 is provided with cylindrical bearer rings 6 and 7 which roll onto cylindrical bearer rings 8 and 9 of a blanket cylinder 2. To secure the printing plates, not shown here, plate cylinder 1 has a known clamping device 19 (see FIG. 2). The plates are secured to bent edges of the clamping device. Blanket cylinder 2 also has a clamping device 20, with which a rubber blanket, not shown here, is clamped. On the two clamping devices 19 and 20, a gap of, for example, 8 mm exists between the clamping edges, which can cause the aforementioned channel impact in printing groups of the prior art.

Blanket cylinder 2 has on both sides additional conical bearer rings 10 and 11, which roll onto conical bearer rings 12 and 13 of a counter pressure cylinder 3.

As can be seen in the drawing, conical surfaces or cones 26 and 27 of the bearer rings 10 and 11 on the blanket cylinder 2 have the same conical angle and are inclined in the same direction. Conical surfaces, or cones, 28 and 29 of bearer rings 12 and 13 have the same conical angle as conical surfaces 26 and 27 of the bearer rings 10 and 11 but are inclined in the opposite direction.

Figure 2:
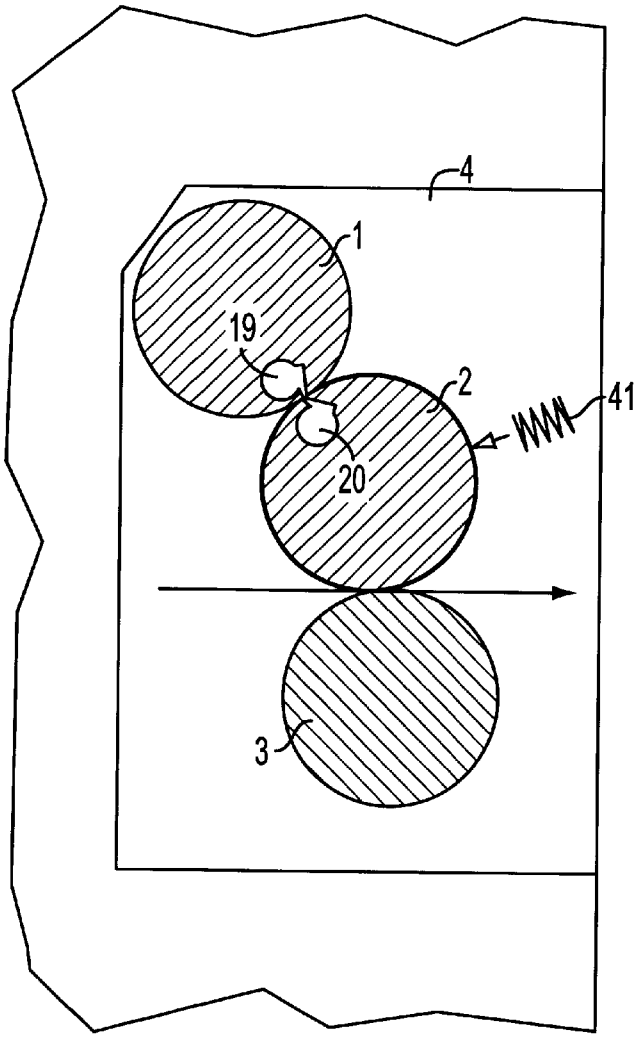
FIG. 2 is a schematic section through the printing group according to FIG. 1.

Blanket cylinder 2 has shaft ends 22 that are spring-loaded by springs 41, as graphically shown in FIG. 2. Consequently, bearer rings 8, 9 of blanket cylinder 2 roll onto bearer rings 6, 7 of the plate cylinder 1 under pressure. Bearer rings 10, 11 of blanket cylinder 2 likewise roll onto bearer rings 12, 13 of counter pressure cylinder 3.

A spindle 14 is disposed at lateral shield 4 with which the counter pressure cylinder 3 can be displaced in its axial direction. In such a displacement, an axial spacing A between blanket cylinder 2 and counter pressure cylinder 3 changes while an axial spacing B between plate cylinder 1 and blanket cylinder 2 remains unchanged.

Similarly, a further spindle 15 is disposed at lateral shield 4 with which plate cylinder 1 is axially displaceable for laterally adjusting the printed image on printing material, for example. During such a displacement, however, axial spacing A between cylinders 1 and 2 and axial spacing B between cylinders 2 and 3 do not change.

Figure 3:
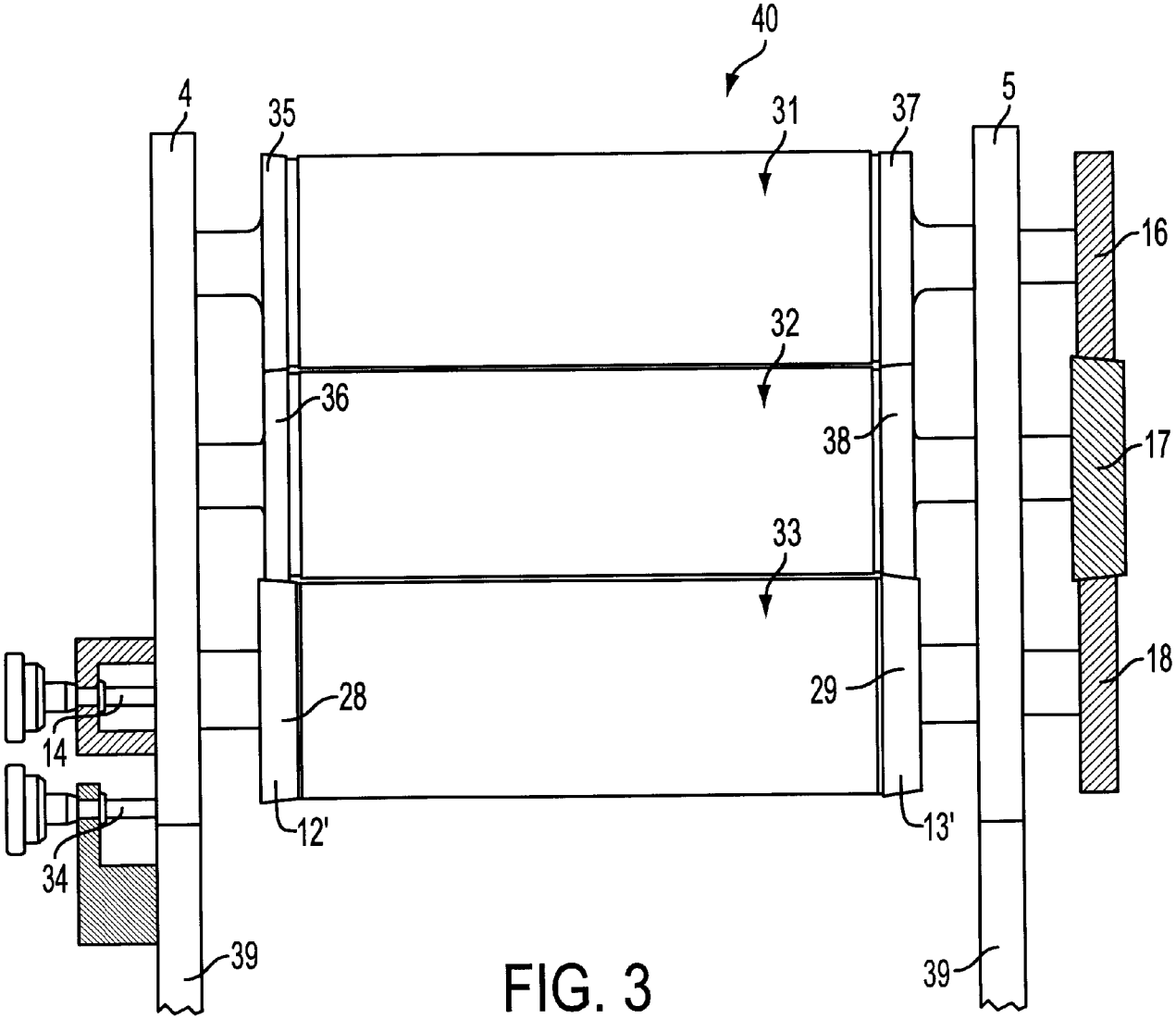
FIG. 3 is a schematic lateral elevation, in partial section, of a printing group according to another embodiment of the invention.

FIG. 3 shows a printing group 40 according to another embodiment of the invention in which a plate cylinder 31 has conical bearer rings 35 and 37, which likewise roll onto conical bearer rings 36 and 38, respectively, of a blanket cylinder 32. The bearer rings of blanket cylinder 32 in turn roll onto bearer rings 12' and 13' of a counter pressure cylinder 33. Cylindrical bearer rings 8 and 9 provided in printing group 30 of FIG. 1 are not required in the embodiment of FIG. 3. Counter pressure cylinder 33 can also be displaced in the axial direction by means of spindle 14 for changing the axial spacing between cylinders 32 and 33. For laterally adjusting the printed image, the three cylinders 31, 32 and 33 can be axially displaced the same distance by a spindle 34 supported on a fixed frame part 39. The axial spacings between the cylinders are not changed in this case.

In printing group 30, as in printing group 40, cylinders 1 through 3, and 31 through 33, respectively, are driven with gears 16, 17 and 18. Gears 17 and 18, which drive cylinders 2 and 3, and 32 and 33, respectively, are adjustable with regard to axial spacing and must be set for the smallest axial spacing so they do not become wedged. If the axial spacing is increased, tooth play occurs, which is undesirable because it leads to printing problems. This tooth play can be eliminated by known filler gears, not shown here.

The aforementioned tooth play can, however, be rendered ineffective by a suitable selection of the bearer ring diameter. If the rolling contact diameter of the bearer rings on the driving cylinder, for example cylinder 3 or 33, is smaller than the rolling-contact diameter of the driven cylinder, for example the cylinder 2 or 32, the driven cylinder will rotate more slowly than the driving cylinder, corresponding to the ratio of the rolling-contact diameters. If cylinders 1 through 3 or 31 through 33 are connected by gears 16 through 18 having the same number of teeth, as shown here, the cylinders are compelled to rotate with the same rpm. A relative motion thereby occurs between the bearer rings of cylinders 2 and 3 or 32 and 33. Because these bearer rings 2 and 3 or 32 and 33 roll onto one another under pressure, a frictional force exists between the rings, which makes tooth play ineffective and renders costly filler gears superfluous.

The printing group of the invention can also have four working cylinders in the following sequence: plate, blanket, blanket and plate. In this embodiment, the end faces of the two blanket cylinders are provided with conical bearer rings, and their axial spacing can be infinitely adjusted. In the printing group 30, counter pressure cylinder 3 would be replaced by a further blanket cylinder and a further plate cylinder. This further blanket cylinder and the blanket cylinder 2 would then be provided with conical bearer rings, and their axial spacing would be infinitely adjustable.

The invention has been described in detail with respect to preferred embodiments, and it will not be apparent from the foregoing to those skilled in the art that changes and modifications may be made without departing from the invention in its broader aspects, and the invention, as defined in the appended claims is intended to cover all such changes and modifications as fall within the true spirit of the invention.

What is claimed is:

1. A printing group for a printing press comprising a plate cylinder, a blanket cylinder operatively coupled to the plate cylinder and having two end faces each of which has a conical bearer ring with the bearer rings on the blanket cylinder each having conical surfaces with the same conical angle and inclined in the same direction as each other, a further cylinder having two conical bearer rings each having conical surfaces with the same conical angle as the conical angle of the bearer rings of the blanket cylinder and inclined in an opposite direction from the direction of inclination of the conical surfaces of the bearer rings of the blanket cylinder, means for applying pressure to the blanket cylinder so that the conical bearer rings of the blanket cylinder roll onto the conical bearer rings of the further cylinder under pressure, and a plurality of gears, each for driving a respective one of the cylinders, wherein one of the cylinders is a driving cylinder and least one of the other cylinders is a driven cylinder, and the bearer rings of the driving cylinder have a rolling-contact diameter that is smaller than a rolling-contact diameter of the bearer rings on the driven cylinder, and each of the gears have the same number of teeth so that a frictional force exists between the bearer rings for eliminating tooth play.

2. The printing group as defined in claim 1, wherein the further cylinder is a counter pressure cylinder, and the counter pressure cylinder is displaceable in an axial direction for changing an axial spacing between the counter pressure cylinder and the blanket cylinder.

3. The printing group as defined in claim 2, and further comprising a spindle operatively coupled to the counter pressure cylinder for axially displacing the counter pressure cylinder.

4. The printing group as defined in claim 1, wherein the further cylinder is a further blanket cylinder and the printing press additionally includes a further plate cylinder operatively coupled to the further blanket cylinder, and wherein the bearer rings on the blanket cylinder have conical surfaces with the same conical angle and inclined in the same direction, and the bearer rings of the further blanket cylinder have conical surfaces with the same conical angle as the conical angle of the bearer rings of the blanket cylinder and inclined in an opposite direction from the direction of the conical surfaces of the bearer rings of the blanket cylinder.

5. The printing group as defined in claim 4, wherein the further blanket cylinder is displaceable in an axial direction for changing the axial spacing between the further blanket cylinder and the blanket cylinder.

6. The printing group as defined in claim 5, and further comprising a spindle operatively coupled to the further blanket cylinder for axially displacing the further blanket cylinder.

7. The printing group as defined in claim 1, wherein the blanket cylinder includes a cylindrical bearer ring and a conical bearer ring at each end face.

8. The printing group as defined in claim 1, wherein the plate cylinder includes two end faces each having a conical bearing ring that rolls on one of the conical bearer rings of the blanket cylinder.

9. The printing group as defined in claim 1, wherein the printing press comprises a rotary offset press.

* * * * *